US006676403B2

(12) United States Patent
Potma

(10) Patent No.: US 6,676,403 B2
(45) Date of Patent: Jan. 13, 2004

(54) SELF EXTINGUISHING AND SELF CLEANING CANDLE HOLDER

(76) Inventor: Theodorus Gerhardus Potma, Rietbergstraat 173, 7201 GG Zutphen (NL)

( * ) Notice: Subject to any disclaimer, the term of this patent is extended or adjusted under 35 U.S.C. 154(b) by 0 days.

(21) Appl. No.: 10/010,260

(22) Filed: Dec. 7, 2001

(65) Prior Publication Data

US 2002/0085376 A1 Jul. 4, 2002

Related U.S. Application Data

(63) Continuation of application No. PCT/NL00/00385, filed on Jun. 6, 2000.

(30) Foreign Application Priority Data

Jun. 8, 1999 (NL) ..... 1012255

(51) Int. Cl.[7] ..... F23Q 25/00
(52) U.S. Cl. ..... 431/35; 431/289
(58) Field of Search ..... 431/33, 35, 289

(56) References Cited

U.S. PATENT DOCUMENTS

| | | | | | |
|---|---|---|---|---|---|
| 728,427 | A | * | 5/1903 | Todenwarth | 431/35 |
| 785,896 | A | * | 3/1905 | Kühnert | 431/35 |
| 1,331,709 | A | * | 2/1920 | Harmata | 431/289 |
| 1,517,115 | A | * | 11/1924 | Handler | 431/35 |
| 2,004,515 | A | * | 6/1935 | Beghetti | 431/289 |
| 2,163,137 | A | * | 6/1939 | Ager-Wick | 431/289 |
| 4,138,211 | A | | 2/1979 | Kampfer et al. | 431/35 |
| 4,818,214 | A | | 4/1989 | Ronnback | 431/35 |

FOREIGN PATENT DOCUMENTS

| | | | | |
|---|---|---|---|---|
| DE | 154106 | | 11/1904 | |
| DE | 357029 | | 8/1922 | |
| DE | 19548365 | | 7/1997 | |
| EP | 0483925 | | 5/1992 | |
| JP | 10-162643 | A * | 6/1998 | 431/35 |
| NL | 1012255 | C * | 2/2001 | |

* cited by examiner

*Primary Examiner*—Sara Clarke
(74) *Attorney, Agent, or Firm*—Ladas & Parry

(57) ABSTRACT

The invention is related to a candle holder for various candle diameters, whereby the candle (4) is clamped between at least two clamping surfaces to clamping edges (1, 2, 3; 1*a*, 2*a*, 3*a*, 4*a*; 1*b*, 2*b*, 3*b*, 4*b*) which are movable in respect to each other and are in general moved towards each other by means of a spring. In case of the known candle holders the candle is extinguished when the melting zone of the burning candle approaches or reaches the clamping surfaces. The characteristic of the candle holder is that there is under the clamping surfaces (1, 2, 3; 1*a*, 2*a*, 3*a*, 4*a*; 1*b*, 2*b*, 3*b*, 4*b*) a candle chamber (6) which has an opening at the upper side, which opening is partly or completely closed when the clamping surfaces move towards each other.

19 Claims, 6 Drawing Sheets

SELF EXTINGUISHING AND SELF CLEANING CANDLE HOLDER

This application is a continuation of copending International Application PCT/NL00/00385 filed on Jun. 6, 2000, which was published in English, claims the benefit thereof and incorporates the same by reference.

TECHNICAL FIELD

The invention relates to a candle holder suitable for candles of various diameters, wherein the candle is pressed between at least two clamping surfaces, which can also have the shape of horizontal or vertical clamping edges, which are movable with respect to each other and are moved towards each other in general by spring force.

BACKGROUND OF THE INVENTION

In case of known candle holders the candle is extinguished as soon as the melting zone of the burning candle approaches or reaches the clamping surfaces.

A disadvantage of known candle holders is that in general the remaining candle stump first has to be removed before a new candle can be placed. Another disadvantage is that in such cases the clamping surfaces have to be cleaned first from candle wax or tallow residues. These types of candle holders often do not fulfil certain esthetic demands either because the existing mechanism quickly becomes dirty due to candle wax residues.

SUMMARY OF THE INVENTION

These disadvantages can be overcome partly or completely by means of the invention. The candle holder according to the invention is characterized in that there is a candle chamber below the clamping surfaces, which chamber has an opening at the upper side and which opening is partly or completely closed as the clamping surfaces move towards each other.

BRIEF DESCRIPTION OF THE DRAWINGS

The invention will be explained further by means of the following figures, in which.

DETAILED DESCRIPTION OF THE DRAWINGS

Figure 1A:
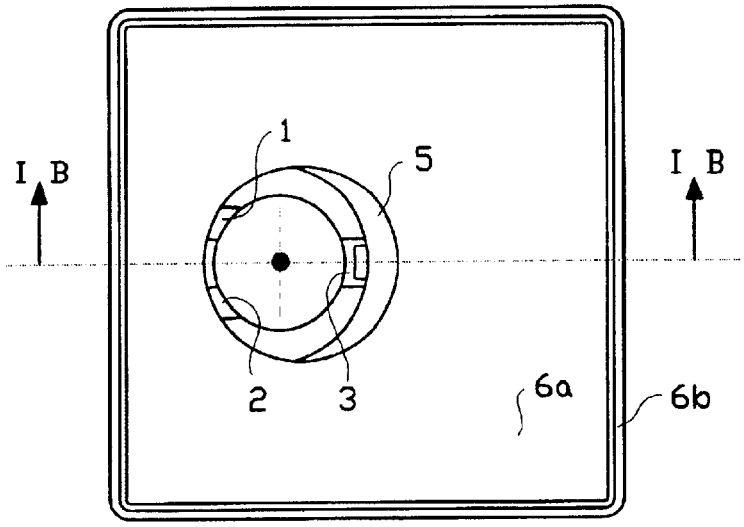
FIGS. 1A–D and 2A–C show sketches of the candle holder according to the invention in which the opening of the candle chamber is closed by means of horizontal closing plates.
Figure 1B:
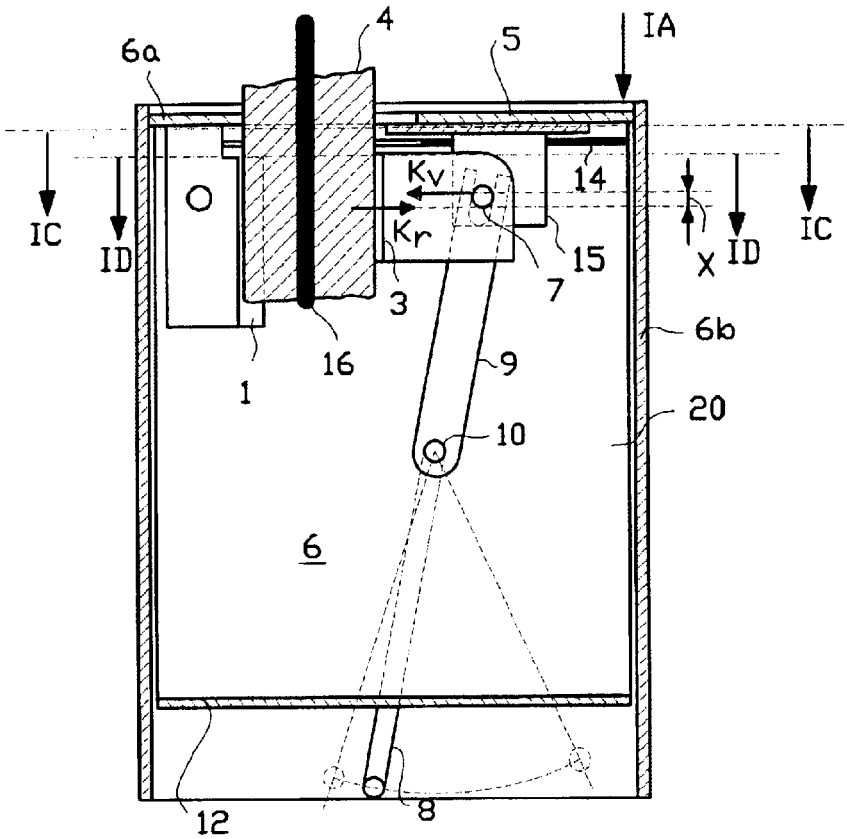
Figure 1C:
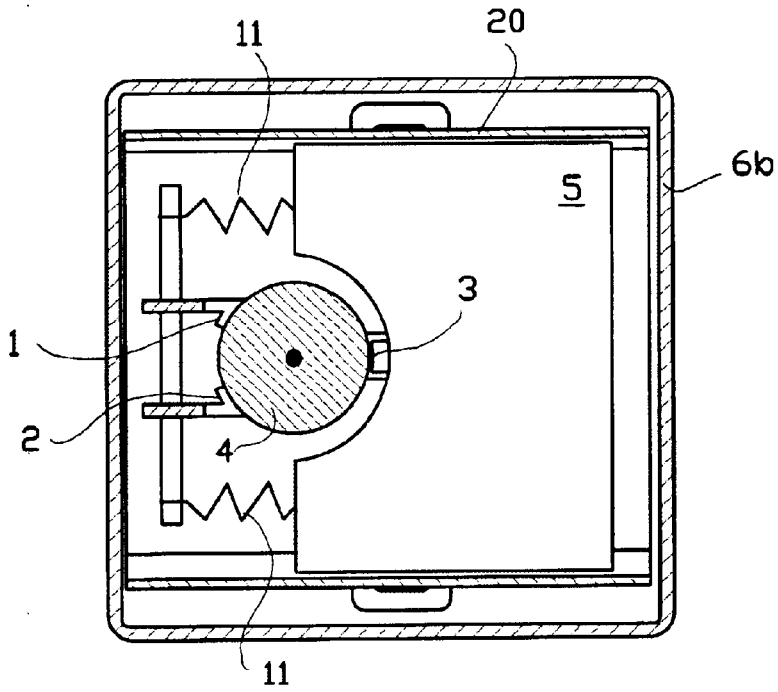
Figure 1D:
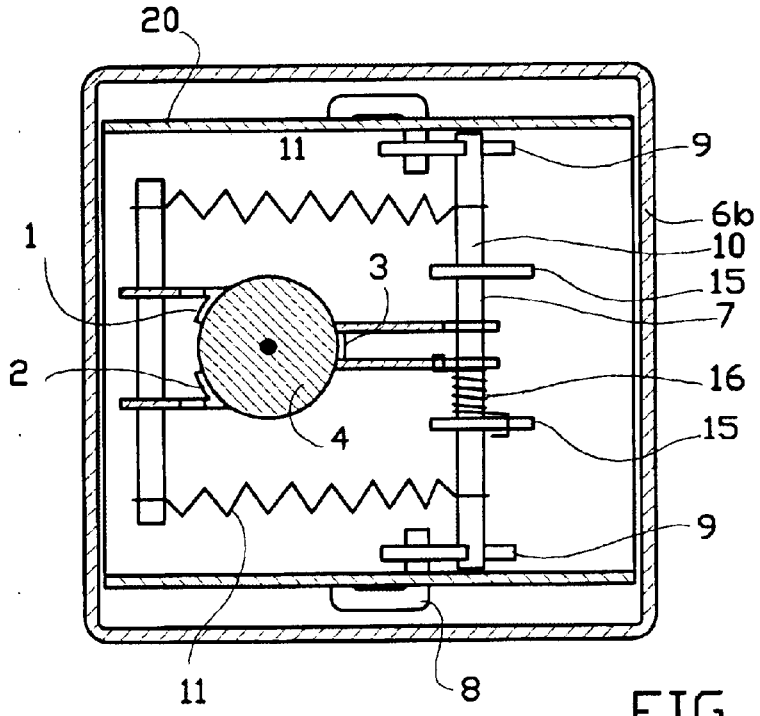

In FIGS. 1 A–D the candle 4 is clamped between three vertical clamping surfaces 1, 2 and 3. The clamping surfaces 1 and 2 here are fixed to the cover 6*a* of the candle chamber 6 located within sleeve 6*b*. Clamping surface 3 is movable in horizontal direction, as a result of which the candle can be clamped between the clamping surfaces 1, 2 and 3. Clamping surface 3 is connected to closing plate 5 which is designed as a slide by which means the candle chamber 6 is closed when the moving clamping surface 3 reaches the outermost left position. In this embodiment the vertical clamping surface 3 can be turned via the horizontal shaft 7. Shaft 7 is connected to slide 5 through plate 15 and to side walls 20. Cover 6*a*, bottom 12 and the side walls 20 of the candle chamber 6 together form one part which can be taken out via the bottom side of sleeve 6*b*. A separate cover is also possible.

The operation of the candle holder is as follows. From the moment the melting zone of the burning candle 4 reaches the top side of the clamping surfaces, the working point of the resulting reaction force Kr, which is exerted by the candle on clamping surface 3, will shift downwards. This creates a rotating moment which tends to turn clamping surface 3 anti-clockwise. The turning moment equals Kr=Kv (the force applied by the springs 11 on shaft 7) multiplied by the distance x. The more the melting zone is going down, the more the length x will increase until at a certain moment the clamping surface 3 will turn, the candle stump will be pushed downwards and the slide 5 will close the candle chamber. In case the candle stump continues to burn, it will be extinguished shortly afterwards for lack of oxygen because the candle chamber is closed. As soon as the candle stump has been pushed out downwards, the clamping surface 3 will return to the starting position under the influence of torsion spring 16.

For the proper operation of the extinguishing mechanism it is not required that there are no other openings in the candle chamber 6 or that the slide 5 closes the top opening completely, as long as the combined flow passage of all existing openings which remains after the clamping surface 3 has reached the outermost left position, is small enough to restrict the airflow to such an extent that the candle stump will be extinguished. All this means that the candle holder is self-extinguishing and to a high degree self-cleaning because the candle stump is pushed out downwards. After the candle stump has fallen into the candle chamber, a new candle can in general be placed immediately. To place a new candle, the movable clamping surface 3 is, directly or with the help of a mechanism available for this purpose, moved to the right, against the spring force. In FIG. 1 the help mechanism consists of a lever 8 turning about shaft 10 and moving the forks 9 which move shaft 7 and the slide 5 with the clamping surface 3 to the right. The movable clamping surface 3 makes it possible to place candles of a wide range of diameters.

In the described embodiment, the candle is clamped between clamping surfaces 1, 2 and 3 and is free from the left edge of closing slide 5 and free from the edge of cover 6*a*. To realize a complete closure of the opening in the candle chamber, clamping surfaces 1, 2 and 3 are made in such a way that they can pass each other in the horizontal direction. This possibility of horizontal passing is also required because clamping surface 3 in the closed position of closing slides 5, must be able to return to the starting position.

It is also possible to use the left edge of closing plate 5 and the edge of the cover 6*a* as clamping edges. In that case these edges must be positioned exactly vertically above the clamping surface 3 and the clamping surfaces 1 and 2, respectively. The vertical clamping surface 3 can also be a part of the outside circumferential surface of a disk which can rotate about shaft 7. In this case it is no longer necessary that the clamping surfaces can pass each other in the horizontal direction in the situation where the left edge of closing plate 5 functions as a clamping edge and for this purpose is positioned vertically above the clamping surface 3.

In the embodiment described above, only the right clamping surface 3 is horizontally movable. It is also possible to use a second slide on the left and to connect the vertical clamping surfaces 1 and 2, which can be turned about a horizontal shaft, to this second slide.

With two or more closing plates it is possible to center the candle with respect to the candle housing. For the centering movement of the clamping surfaces, use can be made of a known mechanism or, use can for example be made of a separate and equally strong spring for each closing plate.

In case there is more than one horizontally movable closing plate connected to it, each plate having a clamping surface that can be turned, the candle stump will in general be ejected better. In this case three horizontal moving closing plates as indicated in FIGS. 2A–C should also be considered.

Figure 2A:
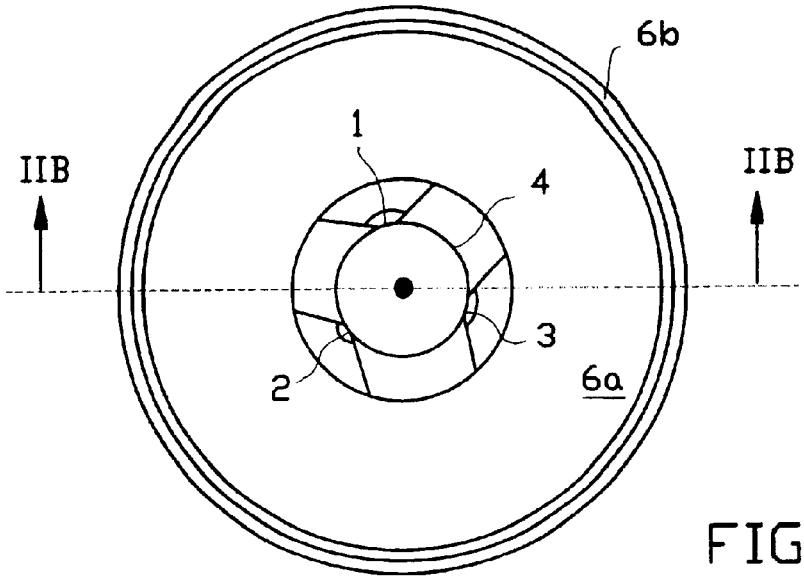
Figure 2B:
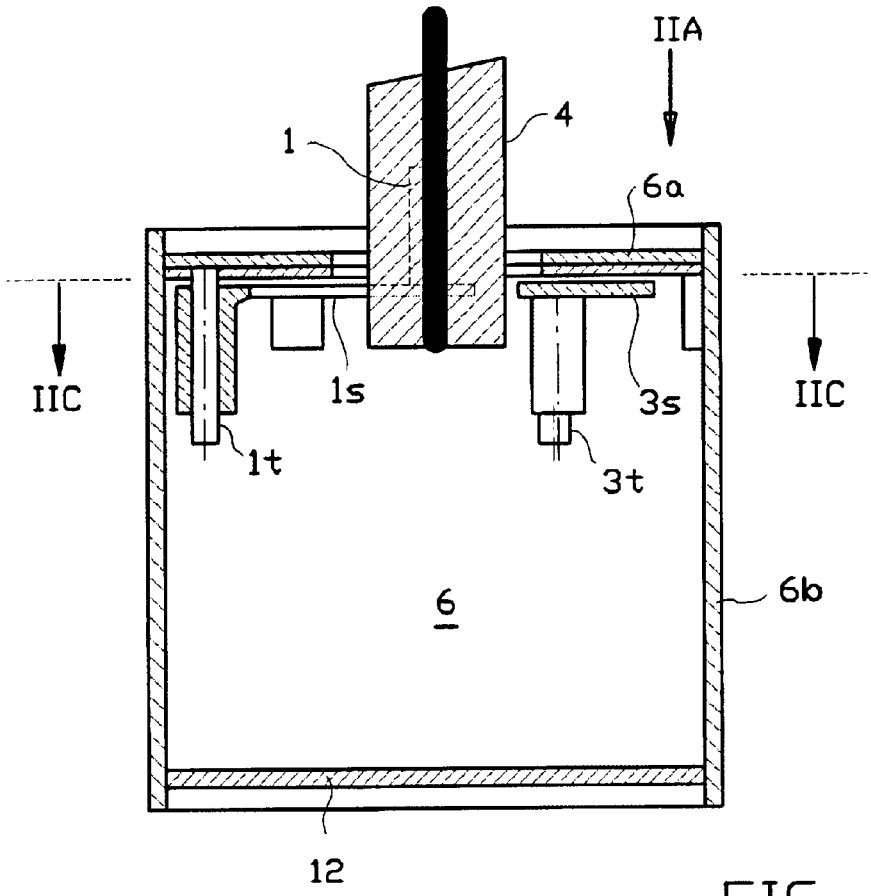
Figure 2C:
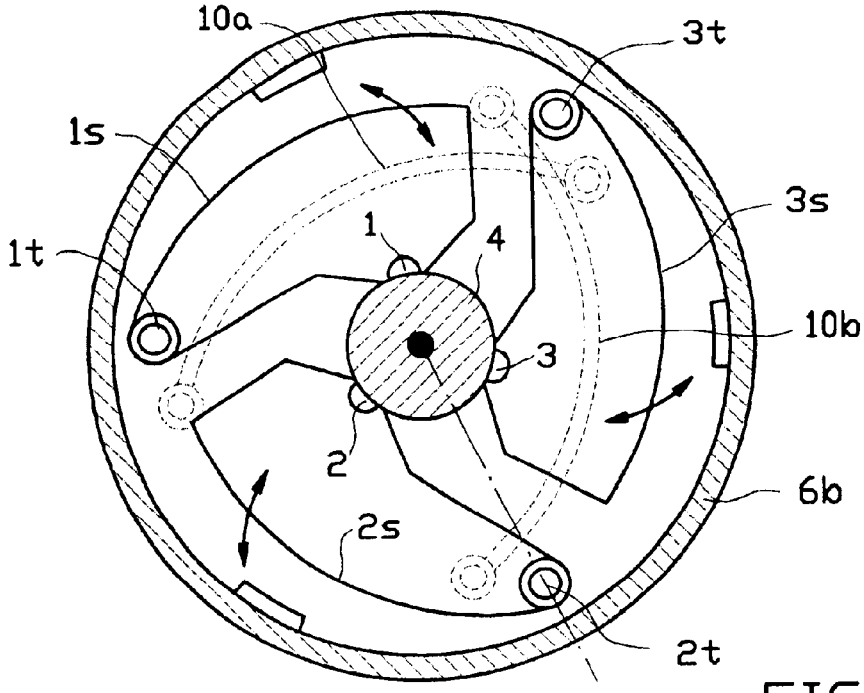

In FIGS. 2A–C there are three vertical clamping surfaces 1, 2 and 3 in the form of a vertical pin each connected to one of three horizontal slides 1*s*, 2*s* and 3*s* which turn about vertical shafts 1*t*, 2*t* and 3*t*. When they move towards each other, these sliding plates or closing plates close the candle holder chamber 6, but leave a small opening in the middle. The movements of the closing plates can be coupled by means of coupling levers 10*a* and 10*b*, in such a way that the sliding plates move simultaneously towards each other and the position of the candle is centered. The coupling levers are indicated in the figure by dotted lines.

In this embodiment the vertical clamping surfaces are connected at the bottom side to horizontal clamping edges which form the ends of the closing plates 1*s*, 2*s* and 3*s*. At the upper side of the vertical clamping surfaces 1, 2 and 3 horizontal plates (not shown in the figure) can also be connected which plates move along with the lower closing plates shown, but which do not obstruct the air flow to the upper side of the lower closing plates in the closed position of the lower closing plates. Said upper plates are meant to improve the clamping of the candle (in case the upper plates also have a clamping edge) and/or for esthetical reasons.

The operation of the candle holder is as follows. As soon as the melting zone approaches the bottom side of the vertical clamping surfaces 1, 2 and 3, the closing plates 1*s*, 2*s* and 3*s* will move towards each other as a result of the spring force. The spring force can for example result from torsion springs (not shown) about vertical shafts 1*t*, 2*t* and 3*t*. The part of the candle stump above the horizontal clamping edges will be squeezed together between the vertical clamping surfaces and the horizontal clamping edges. Some time later the candle stump will fall down because all the candle wax that contacts the clamping surfaces and edges has melted. The candle stump falls in the candle chamber 6 and extinguishes because the closing plates close this chamber sufficiently. It is of importance in this case that the vertical clamping surfaces that are heated by the candle flame, are able to easily transport their heat to the horizontal clamping edges of the closing plates, to effectuate a complete melting of the candle wax and to eliminate the possibility of the candle stump sticking to the closing plates and the clamping surfaces. A downward inclination towards the center of the closing plates can facilitate the flowing away of melted candle wax.

Without there remaining a small opening in the closed position of the closing plates, the candlewick can be clamped between the closing plates. The candle stump will in this situation also be extinguished for lack of supply of candle wax to the flame and will remain hanging in between the closing plates. As soon as the closing plates will be opened for placing a new candle, the candle stump will fall into the candle chamber.

In FIGS. 2A–C the lower closing plates close the candle chamber. In case of upper and lower closing plates the candle holder can also be designed in such a way that only the upper closing plates will close the candle chamber. In this case there is a chance that the air supply to the burning candle stump, after the candle stump has been squeezed together, will be cut off before it has burnt up sufficiently to fall down. This means that the candle stump squeezed together will be extinguished and remains in this state between the lower clamping edges, which means that the self-cleaning effect is disturbed. In order to in this case postpone the squeezing together of the candle stump as much as possible it is advisable to reduce the heat transport from the upper clamping edges to the lower clamping edges by using heat-isolating means.

In this embodiment it is also advisable to have surfaces having a downward inclination in the outside direction, at the bottom side of the lower clamping edges, in order to facilitate the pushing downwards of the candle stump.

In case of the embodiments with three (or more) horizontal closing plates described above, it is also possible to have a vertical clamping surface moving along with the closing plates under each closing plate, which vertical clamping surfaces can be turned about a horizontal shaft as has been described for the vertical clamping surfaces in FIG. 1*a*.

Figure 3A:
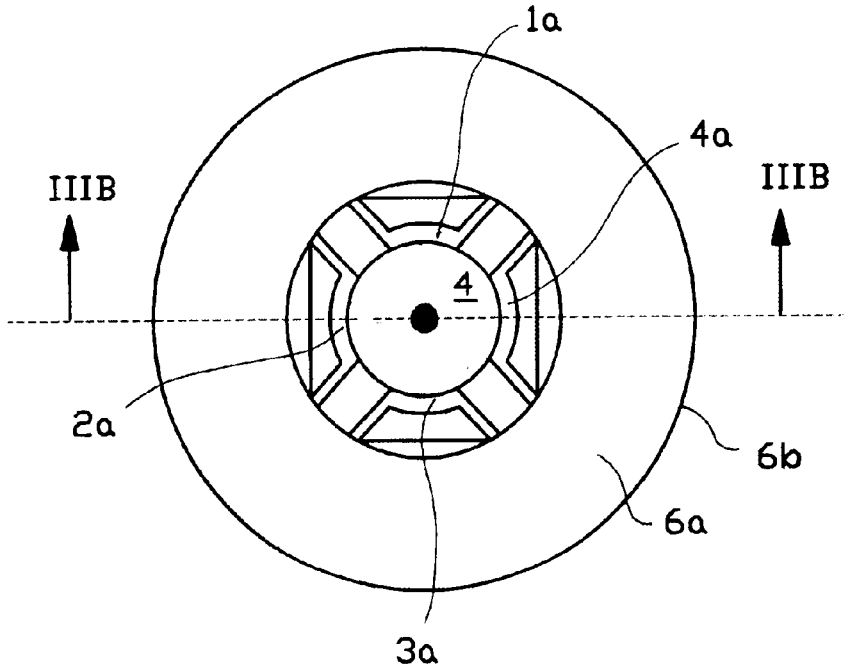
FIGS. 3A–C and 4A,B show embodiments in which the opening is closed by means of closing plates which rotate about a horizontal shaft.
Figure 3B:
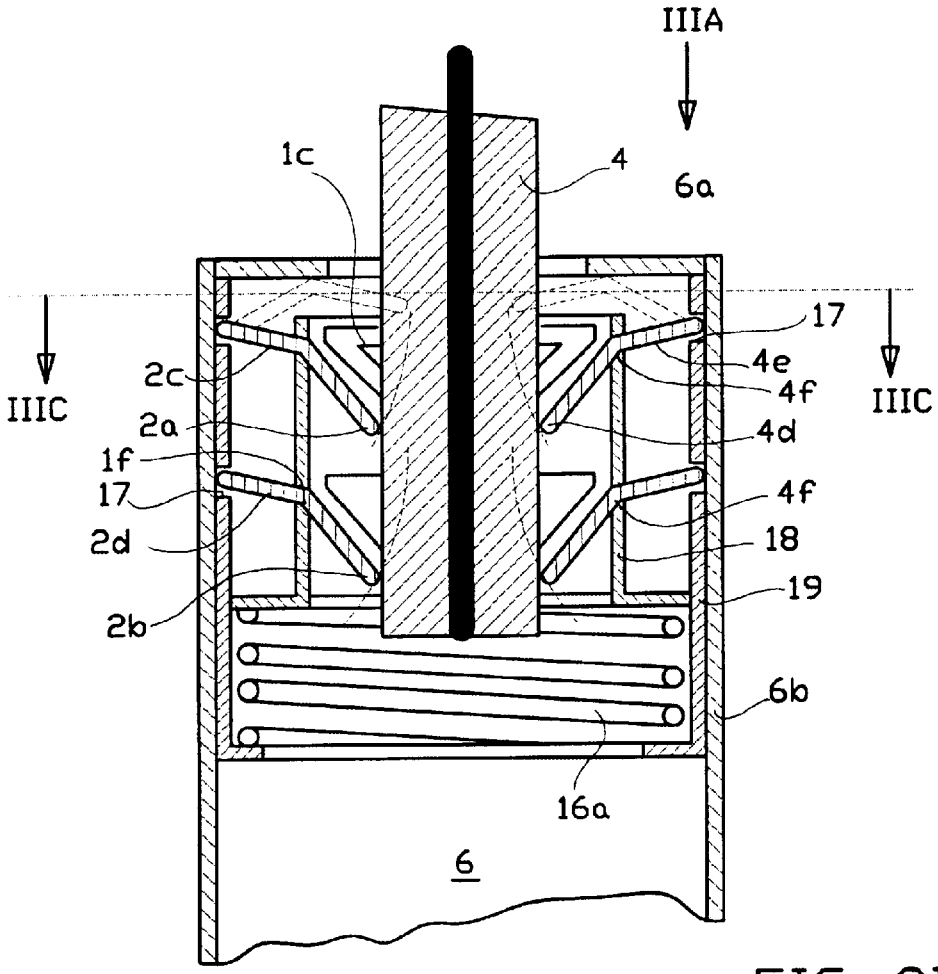
Figure 3C:
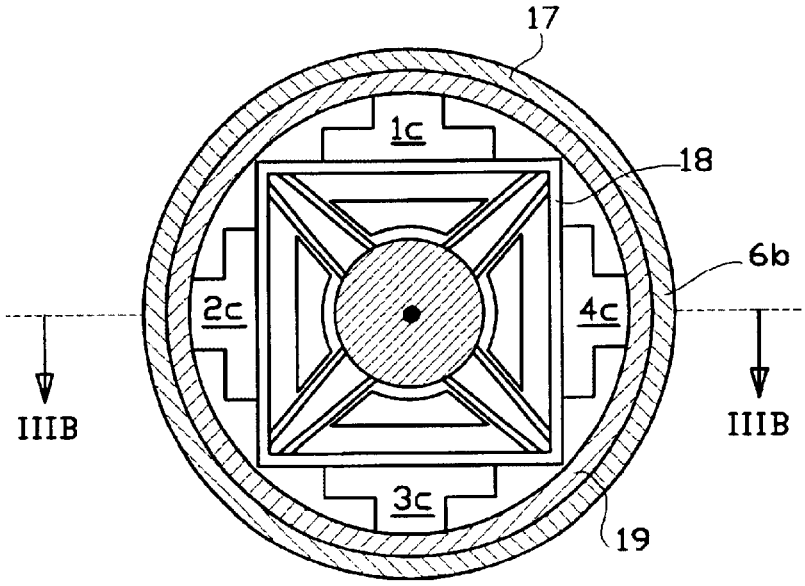

FIGS. 3A–C show an embodiment with a tube-shaped cylindrical candle house and with an upper set of clamping edges 1*a*–4*a* and also a lower set of clamping edges 1*b*–4*b*. The clamping edges here are the edges of a set of upper plates 1*c*–4*c* and the edges of a set of lower plates 1*d*–4*d* which here serve as closing plates. The closing plates turn about horizontal shafts 1*f*–4*f*, which are situated close to the inner wall of the cylindrical candle house. The closing plates and the lower plates have outer edges that are received in slots 17 in a sleeve 19 located within sleeve 6*b*. As a result of the turning of the clamping edges, 1*a*–4*a* and 1*b*–4*b* move towards each other in such a way that the centerline of the candle is the same as the centerline of the candle house. The movement of the closing plates towards each other is effectuated by a vertical and upward movement of the horizontal shafts about which the closing plates turn. This is made possible because the closing plates turn about edges of horizontal slots 1*f*–4*f* in a quadrangular tube 18 which tube can move up and down in the interior of the cylindrical candle house under the influence of a spring 16*a*. By means of this construction the clamping edges of the 2×4 closing plates move simultaneously inwards and outwards.

The embodiment makes it possible to move the clamping edges away from each other against the spring force by moving the quadrangular tube downwards or simply by pushing down the upper closing plates with the bottom side of a new candle, which has to be placed in the candle holder. (Pushing down tube 18 directly means that this tube needs to have an extension at the upper side or has to be reachable in another way from the upper side.)

Figure 4A:
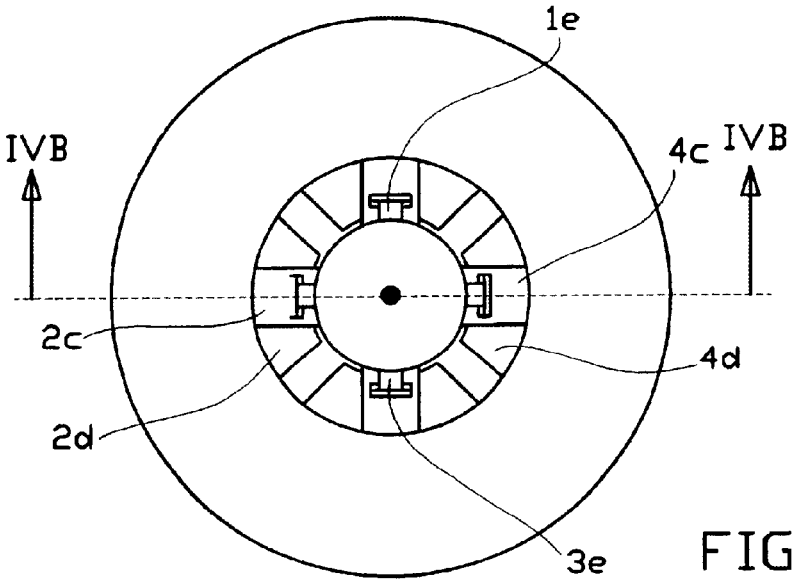

The form of the upper plates here is such that these plates, also in the closed inner position, do not close the opening at the upper side of the candle chamber, as these plates do not have a closing function but only a supporting function and are used to clamp the candle with the upper four clamping edges. The plates also have an esthetical function, among others to partly hide the interior of the candle house from view. In order to safeguard that the upper plates leave enough openings, the upper plates have holes or are shaped as narrow spoke-like strips (see FIGS. 4A,B) with sufficient room between the strips.

The operation of the candle holder is as follows. In the starting position the clamping edges of the closing plates press against the candle. This centers the candle 4 in the candle house and clamps the candle under the influence of spring 16*a*. As soon as the melting zone of the burning candle reaches or approaches the lower clamping edges, the upper and lower closing plates will move towards each other and the part of the candle stump above the lower closing plates 1*d*–4*d* will be squeezed together, the oxygen supply to the candle flame being safeguarded by means of the openings in the upper closing plates. Some time later, when all the candle wax around the lower closing plates has melted, the candle stump will fall into the candle chamber and will be extinguished because the lower closing plates prevent a sufficient air supply to the candle flame. In order to prevent a clamping of the candlewick between the lower closing plates these closing plates leave a small central opening free.

Figure 4B:
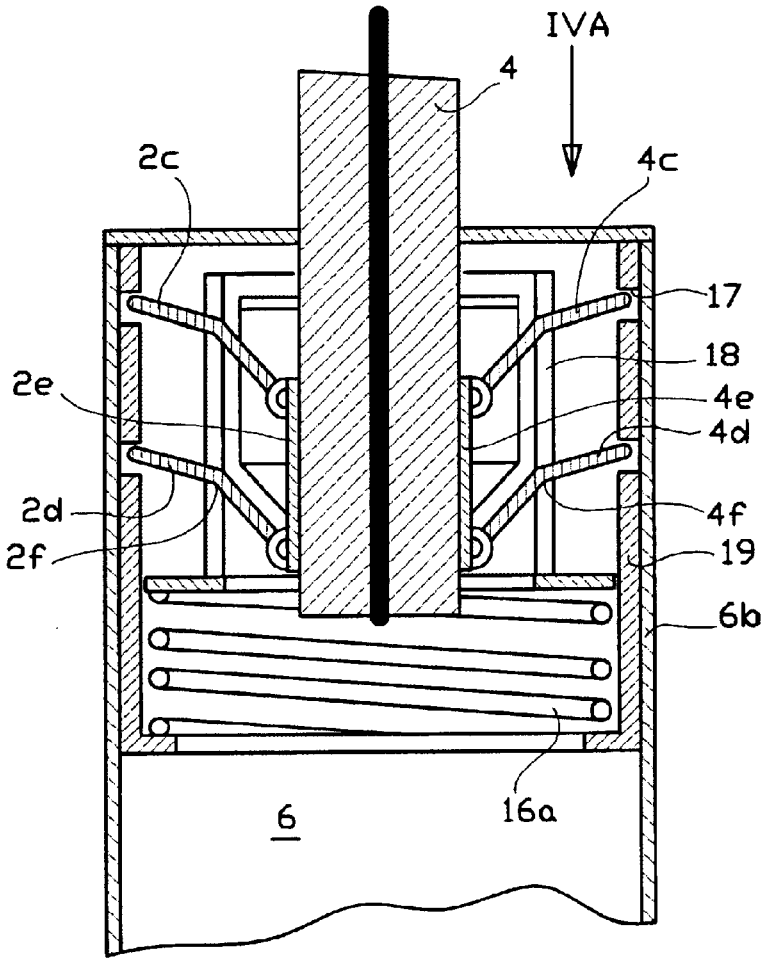

To improve the melting of the remaining candle stump squeezed together, a good heat transport from the upper closing plates to the lower closing plates is desired and can be improved among others by connecting the upper and lower closing plates by means of hinged levers 1*e*–4*e* which connect the upper and lower plates, as has been indicated in FIG. 4B.

A new candle can be placed by pushing the bottom side of the candle downwards against the upper closing plates and pushing the candle down until the bottom side has passed the lower closing plates. A possible previous candle stump sticking to the lower closing plates will thus be pushed down into the candle chamber.

As has already been described at the end of the description of FIGS. 2A–C, the upper closing plates can here also be shaped in such a way that these plates close the opening above the candle chamber. What has been stated at the end of the description of FIGS. 2A–C is relevant here as well.

In the described embodiments the extinguished candle stumps are stored in the candle chamber 6 and can be removed from time to time by means of a removable top or bottom side of the candle house.

The moving away from each other of the clamping edges and clamping surfaces can be realized by means of a two-part candle house consisting of an upper and a lower part, which can be moved or turned with respect to each other, wherein by means of a known mechanism the clamping edges or clamping surfaces move away from each other.

What is claimed is:

1. A candle holder having a housing and at least two clamping members for clamping a candle therebetween, said clamping members being connected to said housing and movable transverse to said candle, wherein a candle chamber is arranged below the clamping members, said chamber having an upper side, an inside and an outside, and an opening at the upper side for receiving said candle, said opening connecting the inside of the chamber to the outside of the candle holder and being partly or completely closed when the clamping members move towards each other, the inside of the candle chamber forming a space for receiving candle stumps fallen through said opening and not being clamped any more between the clamping members.

2. The candle holder according to claim 1, comprising closing plates which are connected to the housing for moving along with the clamping members for reducing or closing the opening when the clamping members are moving towards each other.

3. The candle holder according to claim 2, wherein the closing plates are hinged to said housing at a respective horizontal shaft.

4. The candle holder according to claim 1, wherein the clamping members are arranged for turning movement about a respective horizontal axis.

5. The candle holder according to claim 1, wherein said clamping members form clamping edges.

6. The candle holder according to claim 1, wherein said clamping members form clamping planes.

7. The candle holder according to claim 6, wherein the clamping planes are vertical and are turnable around a horizontal shaft.

8. The candle holder according to claim 6, wherein said clamping planes are hinged to said housing by means of a parallel linkage comprising two link members arranged above each other.

9. The candle holder according to claim 8, wherein the lower one of the link members forms a closing plate for the chamber.

10. The candle holder according to claim 9, wherein the upper one of the link members is shaped in such a way that it admits sufficient air supply downwards to continue the flame of a candle stump when still clamped between the clamping members.

11. The candle holder according to claim 1, designed such that the candle is extinguished when a melting zone of a burning candle reaches or approaches the clamping members.

12. The candle holder according to claim 1, wherein said housing is provided with a removable bottom for emptying said chamber.

13. The candle holder according to claim 1, wherein said housing has a removable top for emptying said chamber.

14. The candle holder according to claim 1, wherein said clamping members are arranged on the housing to be further movable away from each other when a candle is received in said opening.

15. The candle holder according to claim 14, wherein said housing has an upper part and a lower part which can be moved with respect to each other to move the clamping members away from each other.

16. A candle holder having a housing and at least two clamping members for clamping a candle therebetween and connected to said housing, said clamping members being biased for horizontal movement towards each other, and comprising closing members, a candle chamber being arranged below said clamping members and said closing members, said chamber having an upper side having an upper opening for said candle, said opening connecting the inside of the chamber to the outside of the candle holder and being bounded by said clamping members, said closing members forming an upper wall at said upper side of said chamber, the inside of the candle chamber forming a space for receiving candle stumps fallen through said opening and not being clamped any more between the clamping members.

17. The candle holder according to claim 16, wherein said closing members are connected to the clamping members for being biased therewith towards each other.

18. The candle holder according to claim 17, said closing members being kept spaced from each other when no candle is present to leave an opening free in said upper side of said chamber.

19. The candle holder according to claim 17, wherein said closing members and said clamping members are biased to close said upper side of said chamber when no candle is present in said upper opening.

* * * * *